US006150919A

United States Patent [19]

Shimomura

[11] Patent Number: 6,150,919

[45] Date of Patent: Nov. 21, 2000

[54] MULTI-WAY INPUT DEVICE

[75] Inventor: Hisato Shimomura, Miyagi-ken, Japan

[73] Assignee: Alps Electric Co., LTD, Tokyo, Japan

[21] Appl. No.: 09/332,753

[22] Filed: Jun. 14, 1999

[30] Foreign Application Priority Data

Oct. 5, 1998 [JP] Japan ..... 10-282392

[51] Int. Cl.[7] ..... H01C 10/16

[52] U.S. Cl. ..... 338/128; 200/6 A

[58] Field of Search ..... 338/128, 130, 338/131, 132, 134, 68; 273/148 R, 148 B; 74/473.12; 345/161; 200/6 A, 6 B; 463/38

[56] References Cited

U.S. PATENT DOCUMENTS 3,550,466 12/1970 Ham ..... 74/473.12
3,795,882 3/1974 Tokubo ..... 338/128
3,870,161 3/1975 Cording ..... 74/473.12
4,620,176 10/1986 Hayes ..... 338/128
5,107,080 4/1992 Rosen ..... 200/6 A
5,229,742 7/1993 Miyamoto et al. .

FOREIGN PATENT DOCUMENTS 4-36618 7/1990 Japan .

*Primary Examiner*—Karl Easthom
*Attorney, Agent, or Firm*—Brinks Hofer Gilson & Lione

[57] ABSTRACT

In the multi-way input device of the present invention, pivot shaft portions of an operating shaft and engaging portions of a second interlocking member are engaged with each other by snap-fitting to support the operating shaft in the second interlocking member. Thus, the operating shaft can be supported in the second interlocking member easily even by manual operation without requiring any special jig or the like.

4 Claims, 10 Drawing Sheets

MULTI-WAY INPUT DEVICE

BACKGROUND OF THE INVENTION

1. Field of the Invention

The present invention relates to a multi-way input device capable of operating a plurality of electric components at a time by operation of an operating shaft.

2. Description of the Related Art

A conventional multi-way input device is constructed as in FIGS. 11 to 13, in which a first interlocking member 31 curved in an arch shape is disposed in the interior of a frame 30, the frame 30 being formed in the shape of a box having side plates and which is open on its lower side. The first interlocking member 31 has mounting portions 31*a* formed respectively at both ends thereof. The mounting portions 31*a* are fitted respectively into holes 30*c* and 30*a* formed in side plates of the frame 30, whereby the first interlocking member 31 is mounted rotatably in the interior of the frame 30.

A hole 34 is formed in an end face of each mounting portion 31*a* and a rotary shaft 33 of a variable resistor 32 comes into engagement with the hole 34. Further, a slit 35 is formed longitudinally in the arched portion of the first interlocking member 31.

Below the first interlocking member 31 is disposed a second interlocking member 40 in a direction perpendicular to the first interlocking member. The second interlocking member 40, which is formed of a metallic material such as a die casting alloy, is centrally provided with a spherical body 41 and is also provided with right and left arm portions 42 extending horizontally from the spherical body 41, with circular mounting portions 42*a* being projectingly formed respectively at the tips of the arm portions 42. The mounting portions 42*a* are inserted respectively into holes 30*b* and 30*d* formed in the frame 30, whereby the second interlocking member 40 is mounted rotatably in the interior of the frame 30.

A hole 43 is formed in an end face of each mounting portion 42*a* and the rotary shaft 33 of another variable resistor 32 is press-fitted into the hole 43.

A slot 45 is vertically formed centrally through the spherical body 41. The first and second interlocking members 31, 40 are disposed in such a manner that the respective slit 35 and slot 45 intersect each other perpendicularly.

An operating shaft 36 is inserted through the slot 45 of the second interlocking member 40. The operating shaft 36, which is formed of a metal for example, takes a shape such that an oval-shaped support portion 38 is formed centrally and upper and lower support rods are integral with the support portion 38. A disc-like spring shoe 47 integral with the operating shaft 36 is formed at a position close to a lower end portion 36*a* of the operating shaft 36 projecting downward.

A small hole 39 is formed in the support portion of the operating shaft 36. The hole 39 is aligned with a hole 44 formed sideways of the second interlocking member 40 and a round pin 46, which is constituted by a metallic rod for example, is inserted or press-fitted into the thus-aligned holes 39 and 44 and is caulked at both ends thereof, whereby the operating shaft 36 is mounted tiltably to the second interlocking member 40.

The operating shaft 36 extending upward from the support portion 38 is inserted through the slit 35 of the first interlocking member 36. By tilting the operating shaft 36 along the slit 35 of the first interlocking member 31, the second interlocking member 40 can be rotated with its mounting portions 42*a* as fulcrums. A knob 55 is fixed to the upper end of the operating shaft 36 which extends upward from the slit 35.

An operating member 37, which is formed dish-like in external form using a resin material for example, is secured to the lower end portion 36*a* of the operating shaft 36. A boss portion 37*a* is centrally projected on the operating member 37 and the end portion 36*a* of the operating shaft 36 is inserted into a bore 50 formed through the boss portion 37*a* so that the operating member 37 can move vertically.

A bottom plate 49 is mounted so as to cover the lower opening of the frame 30. In this state, the operating member 37 is in elastic contact with the bottom plate 49.

By tilting the operating shaft 36 along the slot 45 of the second interlocking member 40 with the round pin 46 as a fulcrum, the first interlocking member 31 can rotate with its mounting portions 31a as support shafts. Likewise, by tilting the operating shaft 36 along the slit 35 of the first interlocking member 31, the second interlocking member can rotate with its mounting portions 42*a* as support shafts.

The rotary shafts 33 of the variable resistors 32 locked to side plates of the frame 30 are press-fitted in the holes 34 and 43 of the first and second interlocking members 31 and 40 so that both interlocking members and the variable resistors operate integrally with each other.

A generally conical return spring 48 is stretched between the spring shoe 47 of the operating shaft 36 and an inside bottom of the operating member 37. With the biasing force of the return spring 48 the operating member 37 is brought into elastic contact with the bottom plate 49, whereby the operating shaft 36 can be held in an upright neutral state.

The operation of the conventional multi-way inpout device will now be described. First, as shown in FIG. 12, the upper end of the operating shaft 36, when not in operation, projects upright from a hole 56 formed in a top plate of the frame 30 and the operating member 37 is kept in elastic contact with the bottom plate 49 in a horizontal state by means of the return spring 48, so that the operating shaft 36 is in an upright neutral state.

In this state, as shown in FIG. 13, by tilting the operating shaft 36 rightward in a clockwise direction along the slot 45 of the second interlocking member 40, the first interlocking member 31 is rotated, whereby the variable resistor 32 is operated and hence the resistance value thereof can be changed.

As a result of the tilting motion of the operating shaft 36, the operating member 37 tilts as in FIG. 13 and a part of the peripheral edge of the thus-tilted operating member 37 moves in sliding contact with the surface of the bottom plate 49. Consequently, the operating member 37 moves toward the circular spring shoe 47, thereby causing the return spring 48 to be compressed and deflected.

Upon release of the operating force applied to the operating shaft 36, the operating member 37 which has been tilted comes to move in sliding contact with the surface of the bottom plate 49 with the biasing force of the return spring 48. The operating member 37 gradually comes to moves horizontally with respect to the bottom plate 49 and in this way the operating shaft 36 reverts automatically to its upright neutral state shown in FIG. 12.

For operating the variable resistor 32 engaged with an arm portion 42 of the second interlocking member 40, the operating shaft 36 is tilted along the slit 35 of the first interlocking member 31, whereby the second interlocking member 40 is rotated and this rotation permits the variable resistor 32 to operate and change its resistance value.

In the above conventional multi-way input device, however, since the operating shaft 36 is pivotally supported through the round pin 46 by the second interlocking member 40, the number of parts used is large.

Besides, the work of inserting or press-fitting the round pin 46 into the second interlocking member 40 and caulking both ends thereof to prevent dislodgment is needed and therefore the assembling work for the conventional multi-way input device is so much complicated.

SUMMARY OF THE INVENTION

It is an object of the present invention to solve the above-mentioned problems and provide a multi-way input device which permits reduction in the number of parts used and which is superior in assembling efficiency.

According to the first arrangement adopted by the present invention for solving the foregoing problems there is provided a multi-way input device comprising: a first interlocking member which has a longitudinal slit and which is rotatable; a second interlocking member disposed in a direction orthogonal to the longitudinal direction of the first interlocking member, the second interlocking member having a slot and being rotatable; a frame within which the first and second interlocking members are mounted; an operating shaft inserted through both the slit of the first interlocking member and the slot of the second interlocking member and supported tiltably by the second interlocking member; and a plurality of electric components attached to the frame and capable of being operated through the first and second interlocking members by operation of the operating shaft, the operating shaft having pivot shaft portions of a convex or concave shape, and the second interlocking member having engaging portions of a concave or convex shape for engagement with the pivot shaft portions, the engaging portions being formed inside the slot of the second interlocking member, the engaging portions of the second interlocking member and the pivot shaft portions of the operating shaft being engaged with each other by snap-fitting, thereby allowing the operating shaft to be pivotably supported by the second interlocking member.

According to the second arrangement adopted by the invention for solving the foregoing problems there is provided, in combination with the above first arrangement, a multi-way input device wherein the operating shaft has a cylindrical portion, and the pivot shaft portions of the operating shaft are formed on part of an outer wall of the cylindrical portion.

According to the third arrangement adopted by the invention for solving the foregoing problems there is provided, in combination with the above first arrangement, a multi-way input device wherein the operating shaft and/or the second interlocking member are (is) formed using an elastically deformable material.

According to the fourth arrangement adopted by the invention for solving the foregoing problems there is provided, in combination with the above first arrangement, a multi-way input device wherein guide portions for guiding the pivot shaft portions of the operating shaft to the engaging portions of the second interlocking member are formed in part of side walls of the second interlocking member which define the slot.

DETAILED DESCRIPTION OF A PREFERRED EMBODIMENT

Figure 1:
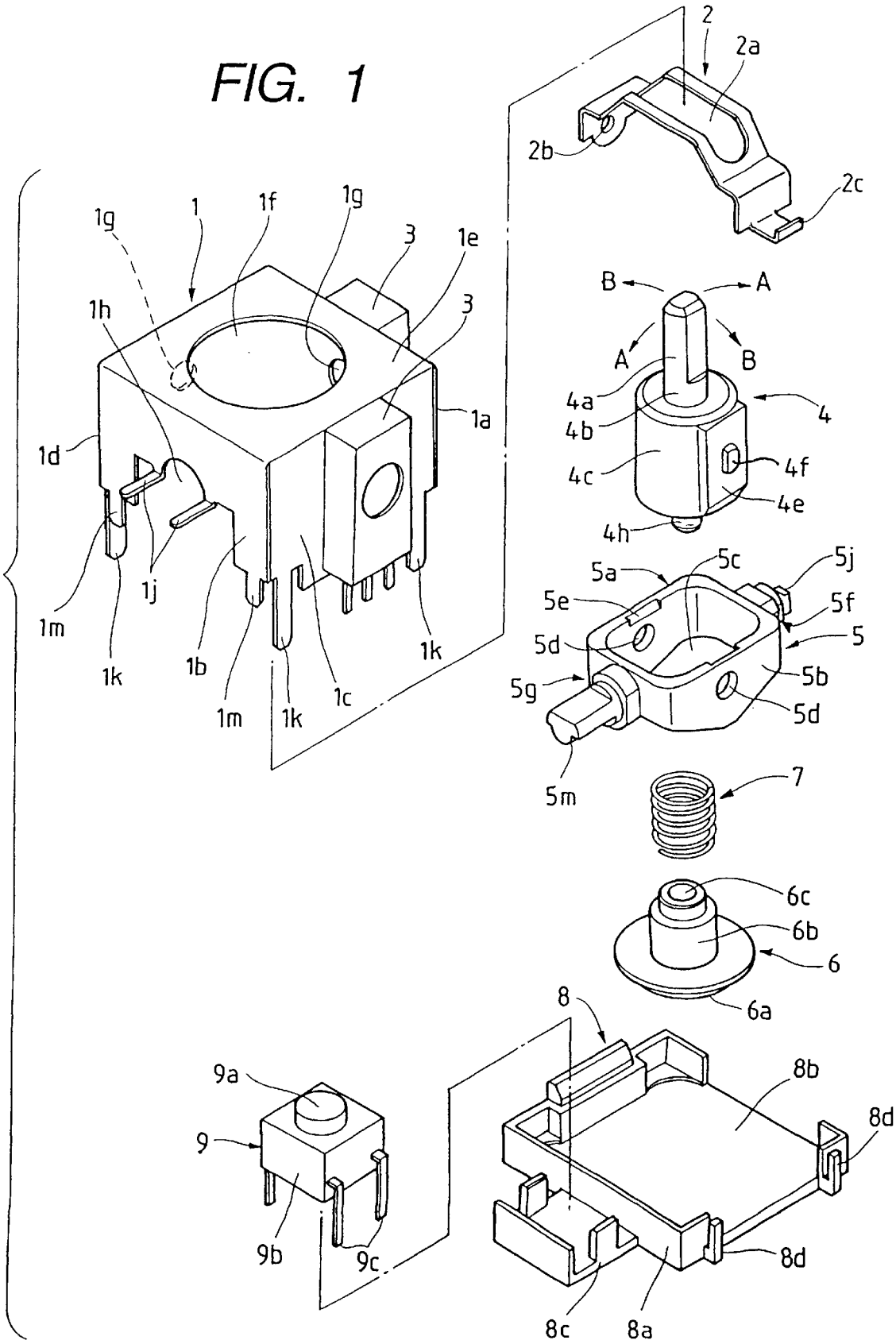
FIG. 1 is an exploded perspective view of a multi-way input device embodying the present invention.
Figure 2:
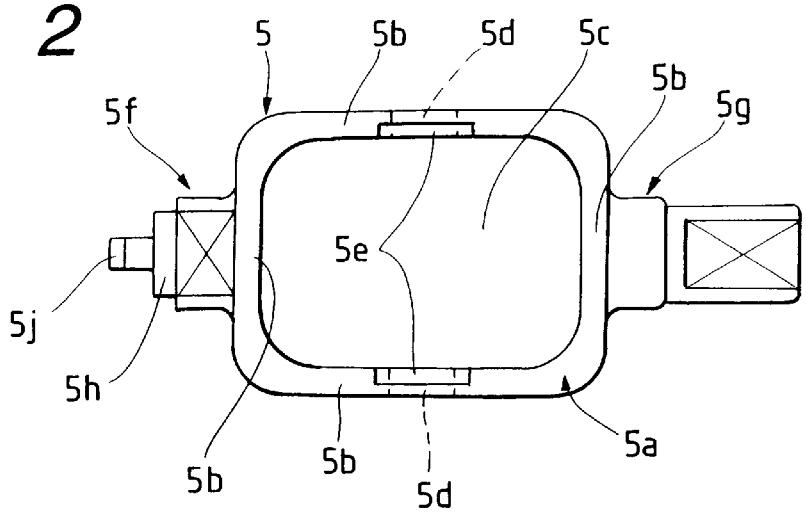
FIG. 2 is a top view of a second interlocking member used in the multi-way input device.
Figure 3:
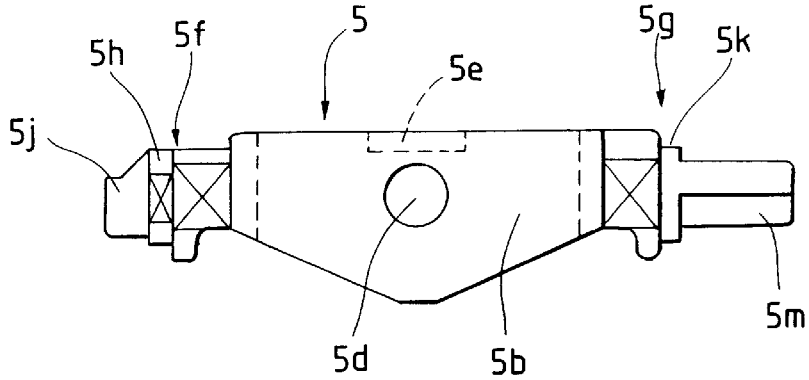
FIG. 3 is a front view thereof.
Figure 4A:
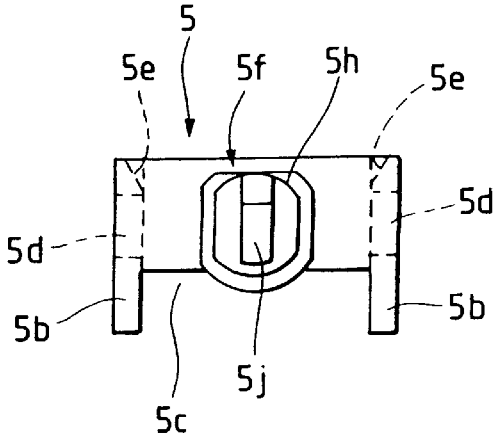
FIG. 4 is a side view thereof.
Figure 4B:
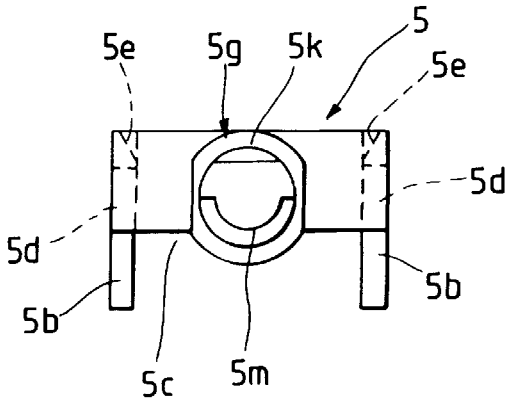
Figure 5:
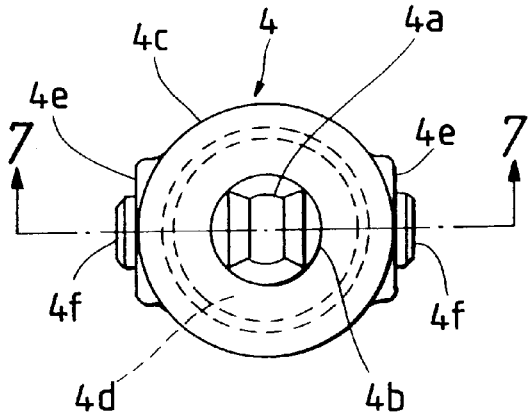
FIG. 5 is a top view of an operating shaft used in the multi-way input device.
Figure 6:
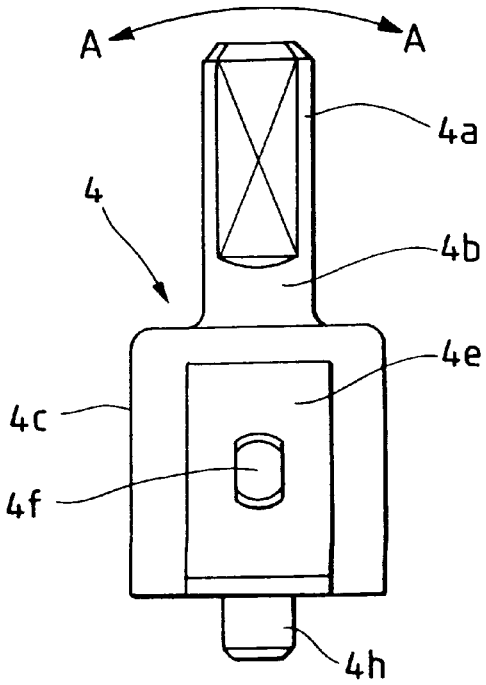
FIG. 6 is a front view thereof.
Figure 7:
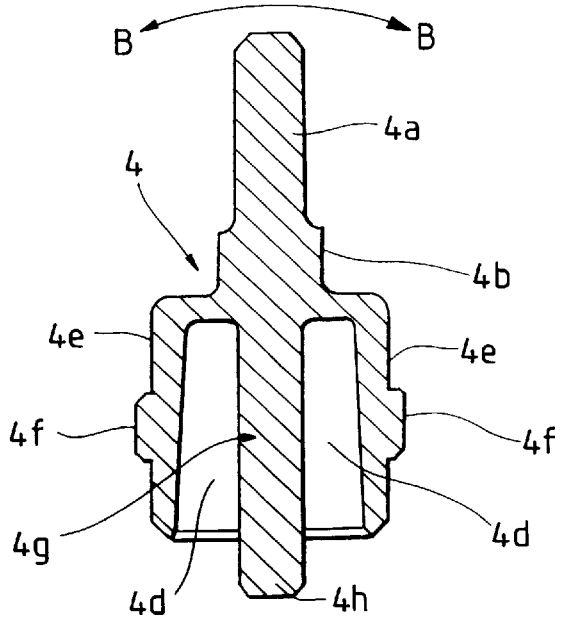
FIG. 7 is a sectional view taken on line 7—7 in FIG. 5.
Figure 8:
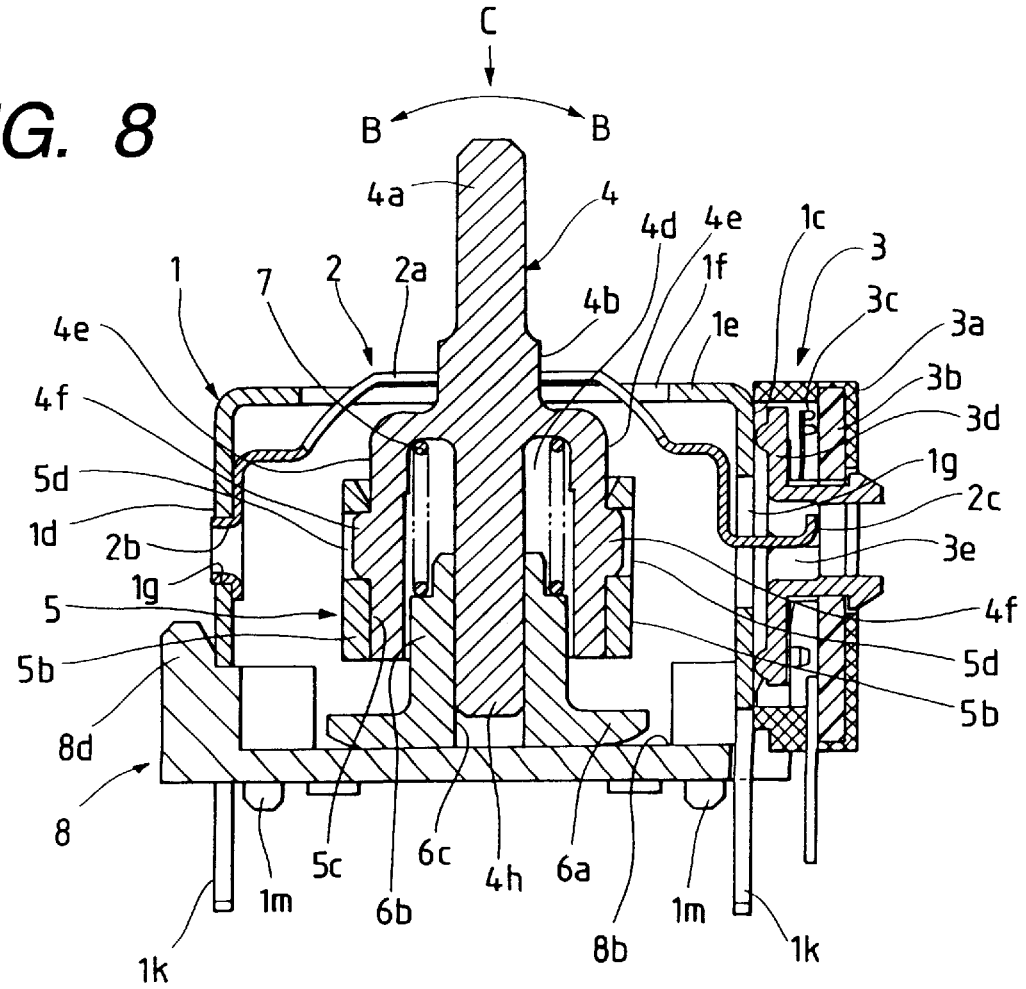
FIG. 8 is a sectional view of a principal portion of the multi-way input device.
Figure 9:
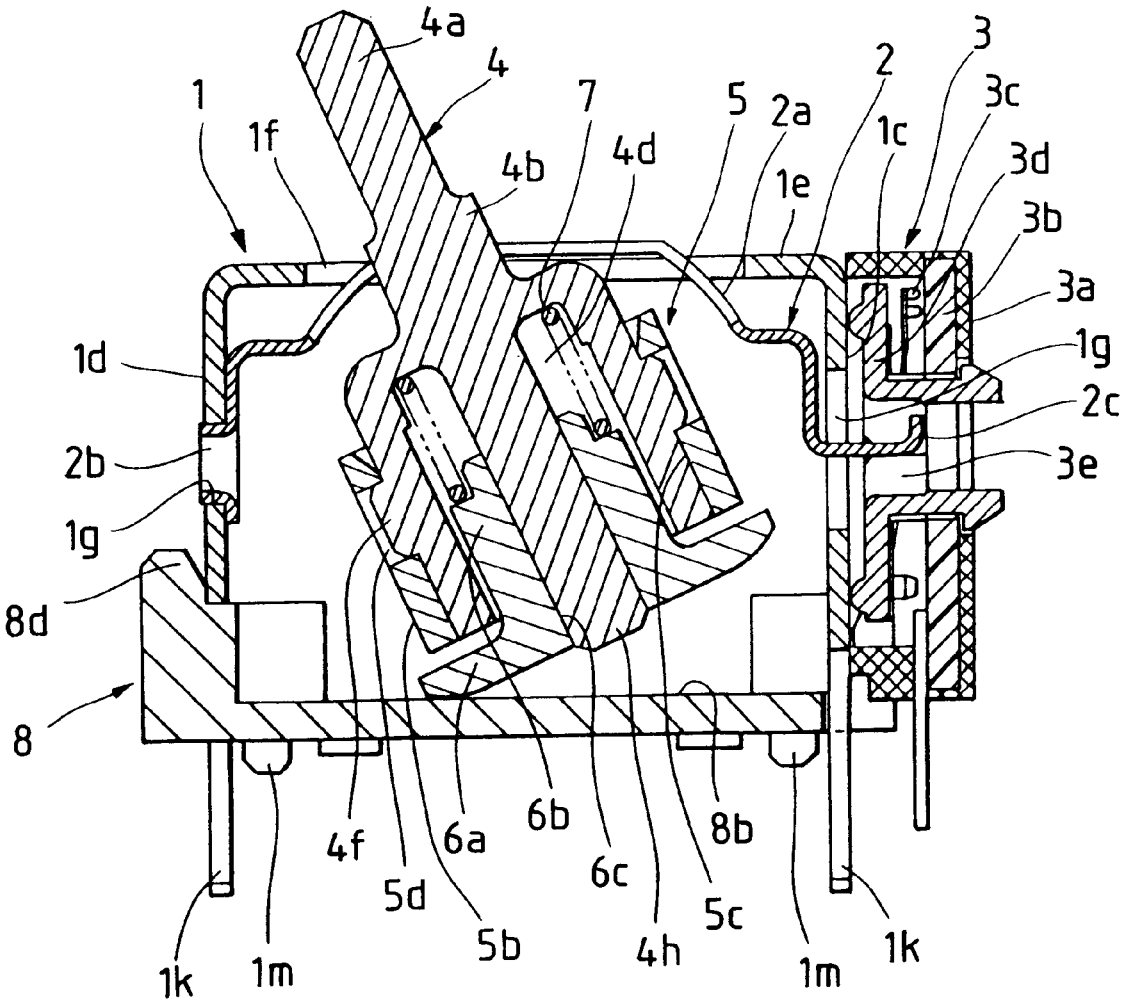
FIG. 9 is a sectional view of the principal portion of the multi-way input device, explaining the operation of the device.
Figure 10:
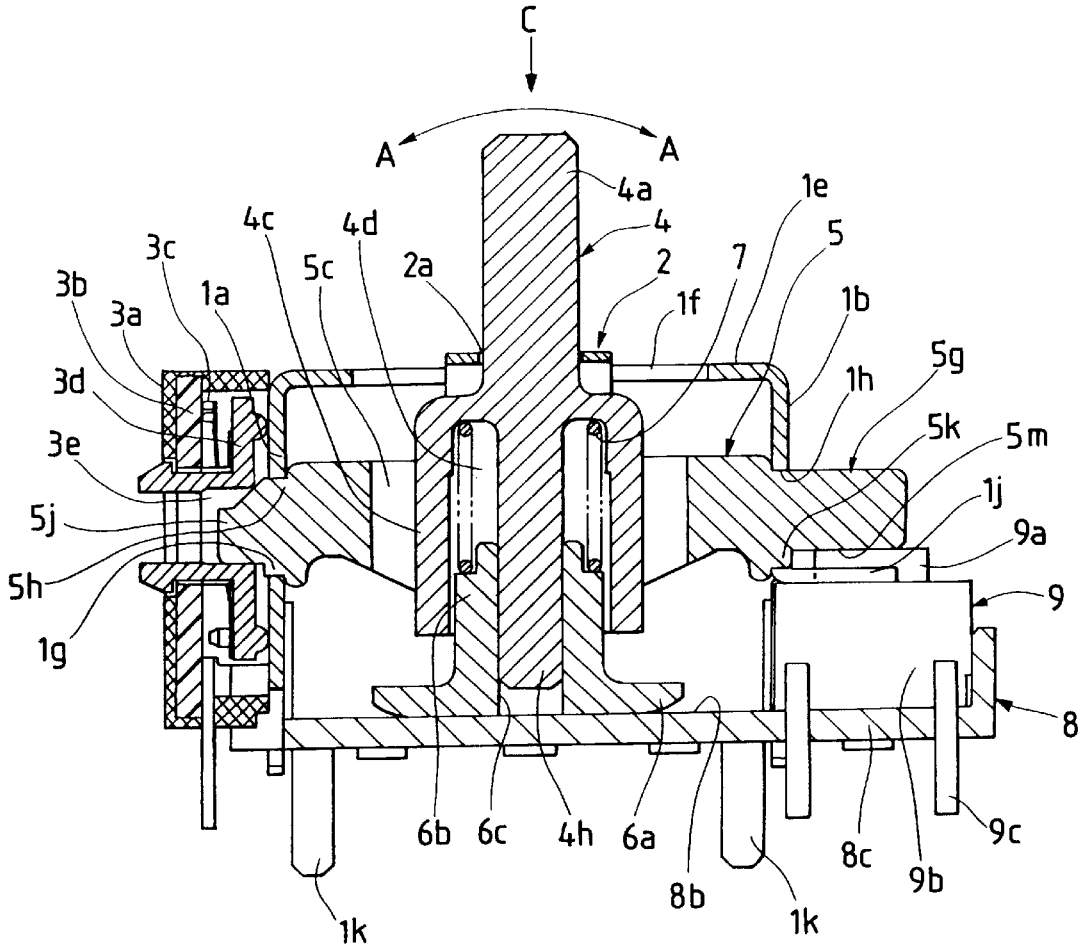
FIG. 10 is a sectional view of a principal portion of the multi-way input device.
Figure 11:
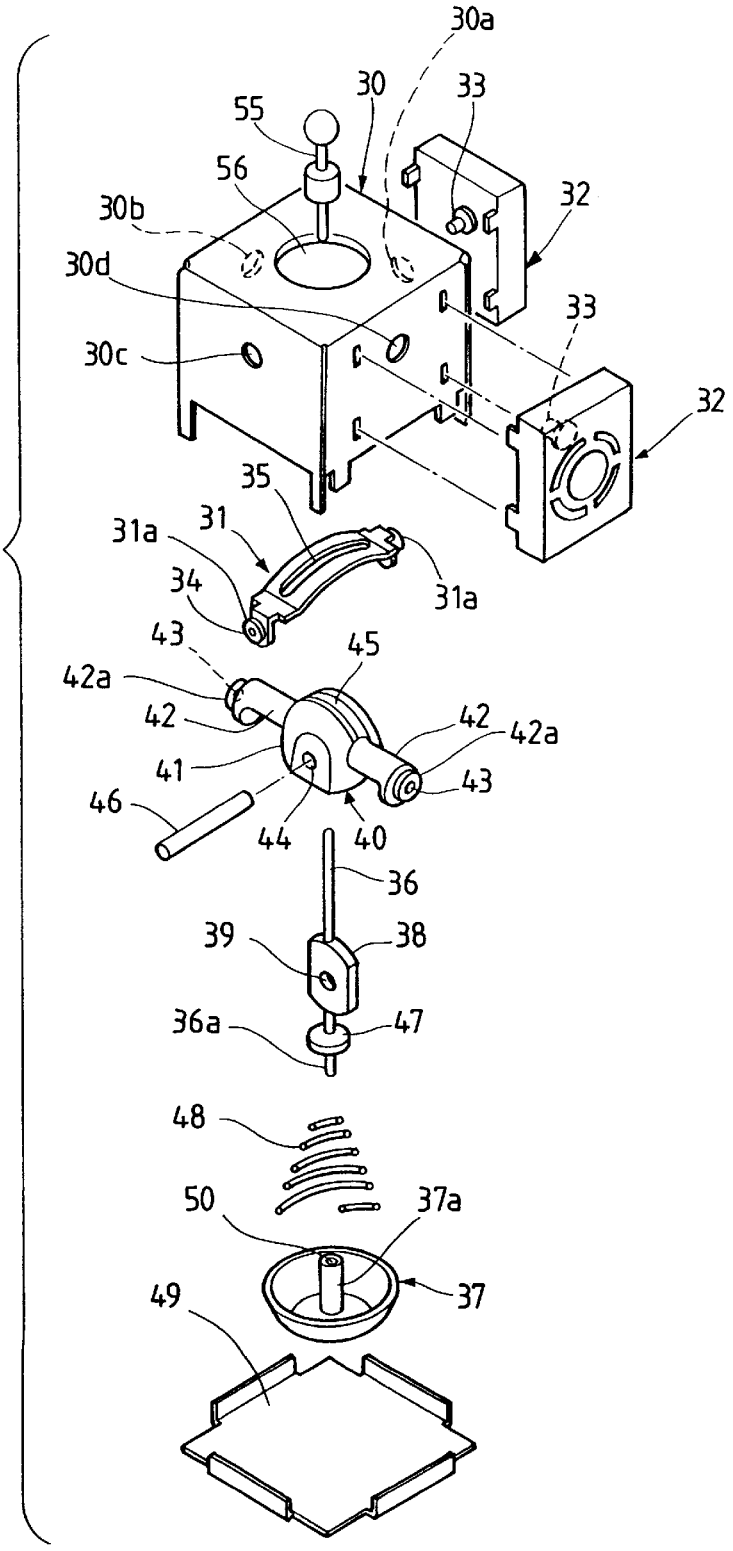
FIG. 11 PRIOR ART
FIG. 11 is a perspective view of a conventional multi-way input device.
Figure 12:
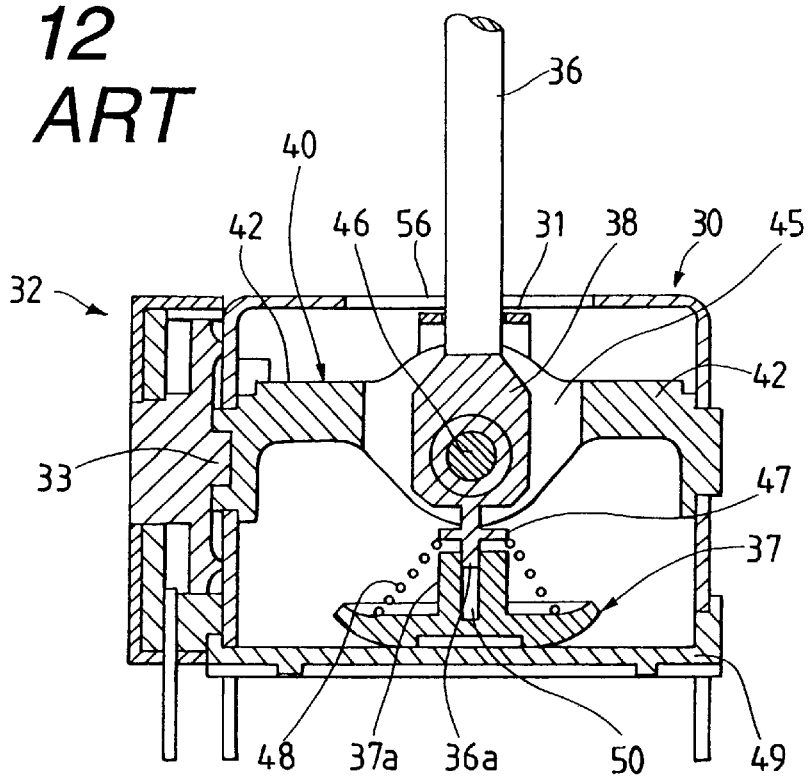
FIG. 12 PRIOR ART
FIG. 12 is a sectional view of a principal portion thereof.
Figure 13:
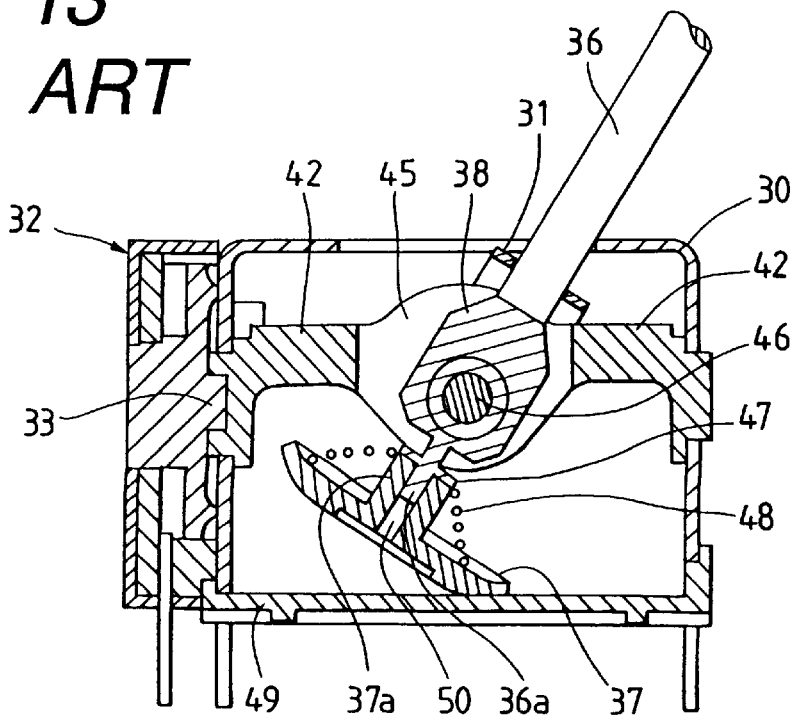
FIG. 13 PRIOR ART
FIG. 13 is a sectional view of the principal portion, explaining the operation of the conventional multi-way input device.

A multi-way input device according to an embodiment of the present invention will be described hereinunder with reference to FIGS. 1 to 10, of which FIG. 1 is an exploded perspective view of the multi-way input device, FIGS. 2 to 4 are diagrams illustrating a second interlocking member used in the multi-way input device, FIGS. 5 to 7 are diagrams illustrating an operating shaft used in the multi-way input device, and FIGS. 8 to 10 are diagrams illustrating the operation of the multi-way input device.

In the multi-way input device, as shown in FIG. 1, a frame 1 is disposed which is formed by an iron plate or the like. The frame 1 has side plates 1*a*, 1*b*, 1*c* and 1*d* formed by bending downward in the figure by means of a press or the like. The frame 1 has a hollow interior and its bottom is open. Its external form is generally in the shape of a rectangular parallelepiped. The top of the frame 1 is covered with a top plate 1*e*, with an operating hole 1*f* being formed centrally in the top plate 1*e*.

Circular holes 1*g* are formed respectively in the three side plates 1*a*, 1*c* and id other than the side plate 1*b*. A plurality of rectangular apertures (not shown) for mounting variable resistors 3 as electric components, which will be described later, are formed in the side plates 1*a* and 1*c*. In the side plate 1*b* opposed to the side plate 1*a* is formed a support portion 1*h* of a generally semicircular shape at a position opposed to the circular hole 1*g* formed in the side plate 1*a*. On both right and left sides of the support portion 1*h* are formed component holding legs 1*j* which are bent outwards approximately at right angles from the side plate 1*b*.

A plurality of mounting terminals 1*k* for mounting the multi-way input device to a printed circuit board (not shown) are extended downward from the lower ends of the opposed side plates 1*c* and 1*d*.

Two tongue pieces 1*m* for mounting a bottom plate 8 which will be described later are formed at lower positions of each of the side plates 1*a* and 1*b*.

A first interlocking member 2 formed for example, of a phosphor bronze plate and the like is disposed within the hollow portion of the frame 1. The first interlocking member 2 is curved upward in an arch shape by means of a press or the like, and a slit 2*a* is formed longitudinally in the arcuate portion by punching.

Both end portions of the first interlocking member 2 are bent downward, and at the thus-bent left-hand end portion in the figure there is formed a projecting pipe-like support portion 2*b*, by drawing for example. The support portion 2*b* is inserted into the circular hole 1*g* of the side plate 1*d*, whereby the first interlocking member 2 is supported rotatably.

The opposite right-hand end portion in the figure of the first interlocking member 2 is bent in a general U shape to form a component operating portion 2*c*. The component operating portion 2*c* is inserted into a circular hole (not shown) formed in the side plate 1*c* of the frame 1 and projects outwards into engagement with a lateral groove formed in the slider receptacle portion 3*d* of a variable resistor 3 to be described later.

The first interlocking member 2 is connected bridgewise to the circular holes formed respectively in the side plates 1*c* and 1*d* of the frame 1, whereby its arcuate portion is mounted rotatably within the frame 1.

For example, two variable resistors 3 as electric components are attached by snap-fitting or any other suitable means to a plurality of rectangular holes (not shown) formed in the side plate 1*a* and the side plate 1*c* adjacent thereto of the frame 1.

Each variable resistor 3 has such a structure as shown in FIG. 8, in which a board 3*b* formed integrally by insert molding, for example, is disposed in the interior of a case 3*a*, the slider receptacle portion 3*d* with a slider piece 3*c* attached thereto is attached to the board 3*b* rotatably by snap-fitting, for example, and an operating portion 3*e* having engaging grooves comprising vertical and lateral grooves is formed at a rotational center of the slider receptacle portion 3*d*.

The component operating portion 2*c* of the first interlocking member 2, which is generally U-shaped and which projects outwards from the circular hole (not shown) formed in the side plate 1*c* of the frame 1, engages the operating portion 3*e* of the variable resistor 3 attached to the side plate 1*c* so that the slider receptacle portion 3*d* of the variable resistor 3 rotates upon rotation of the first interlocking member 2 to change the resistance value of the variable resistor 3.

A knob portion 4*a* of the operating shaft 4 is inserted into the slit 2*a* of the first interlocking member 2. The knob portion 4*a* and a base end portion 4*b* of the operating shaft 4 are movable along the slit 2*a*. The operating shaft 4 is formed of a synthetic resin material. As shown in FIGS. 5 to 7, the knob portion 4*a* is formed in an oval shape and the base end portion 4*b* is formed in a circular shape. A cylindrical portion 4*c* is formed below and integrally with the circular base end portion 4*b*.

The cylindrical portion 4*c* is constituted by a peripheral wall and its lower side is open. In the interior of the cylindrical portion 4*c* is formed a receptacle space 4*d* for receiving therein a generally circular return spring 7 which will be described later. As shown in FIG. 5, on the outer wall of the cylindrical portion 4*c* are formed two flat portions 4*e* in an opposed relation to each other, and on part of the flat portions 4*e* are respectively formed oval-shaped pivot shaft portions 4*f* convexly at predetermined diameter and height.

In the interior of the spring receptacle space 4*d* is integrally formed a shaft portion 4*g* coaxially with the knob portion 4*a*. The shaft portion 4*g* extends downward in the figure so that a lower end 4*h* thereof projects downward to a greater extent by a predetermined length than the spring receptacle space 4*d*.

The operating shaft 4 allows its pivot shaft portions 4*f* to be supported by a second interlocking member 5 and can thereby tilt in both arrow A—A and B—B directions.

The second interlocking member 5, which is formed of a synthetic resin material, is disposed below the first interlocking member 2 in a direction perpendicular to the first interlocking member 2.

As shown in FIG. 2, a support portion 5*a* of a generally rectangular shape is formed nearly centrally of the second interlocking member 5. The support portion 5*a* comprises long and short side walls 5*b* defining an inside space through which is formed a slot 5*c* of a generally rectangular shape.

A pair of engaging portions 5*d* for engagement with the pivot shaft portions 4*f* of the operating shaft 4 are formed respectively in predetermined positions of the long side walls 5*b* of the support portion 5*a*. The engaging portions 5*d* are formed through the side walls or in a concave shape having a predetermined depth. Further, chamfered guide portions 5*e* of a predetermined size are formed respectively at inner edges of the long side walls 5*b* above the engaging portions 5*d* as in FIG. 3.

When the operating shaft 4 is brought into engagement with the second interlocking member 5 by snap-fitting, the chamfered guide portions 5*e* permit the pivot shaft portions 4*f* to be guided smoothly into the engaging portions 5*d*.

As shown in FIG. 3, first and second arm portions 5*f*, 5*g* extend horizontally right and left from the support portion 5*a*. The first arm portion 5*f* extending on one side is formed with a support portion 5*h* of a predetermined diameter, and a plate-like component operating portion 5*j* of a predetermined width projects from the support portion 5*h*.

The second arm portion 5*g* extending on the other side is formed with a support portion 5*k* of a predetermined diameter, and a component operating portion 5*m* having a flat upper surface and a semicircular lower surface extends from the support portion 5*k*.

The support portion 5*h* of the first arm portion 5*f* in the second interlocking member 5 is inserted into the circular hole 1*g* formed in the side plate 1*a* of the frame 1 and is thereby supported rotatably, while the support portion 5*k* of the second arm portion 5*g* is positioned and supported in the semicircular support portion 1*h* of the side plate 1*b*. Thus, the second interlocking member 5 is supported rotatably and its component operating portion 5*m* as one end portion is mounted vertically movably in the interior of the frame 1.

The component operating portion 5*j* of the first arm portion 5*f* is engaged with the vertical groove formed in the operating portion 3*e* of the variable resistor 3 attached to the side plate 1*a*, while the component operating portion 5*m* of the second arm portion 5*g* is positioned on a stem portion 9*a* of an electric component such as a push-button switch 9 attached to a bottom plate 8 which will be described later.

An operating member 6, which is movable in the axial direction of the operating shaft 4, is disposed at the lower end 4*h* of the operating shaft 4 positioned in the interior of the frame 1.

The operating member 6 is formed of a resin material and has a base portion 6*a* on its lower side, the base portion 6*a* having a circular external form and having a dish-like curved bottom. Centrally on the base portion 6*a* is formed a cylindrical boss portion 6*b* projecting toward the interior of the frame 1, with an axial bore 6*c* being formed at a center of the boss portion 6*b*.

The lower end 4*h* of the operating shaft 4 is inserted into the axial bore 6*c* of the operating member 6 and the boss portion 6*b* is fitted movably in the receptacle space 4*d* of the cylindrical portion 4*c*.

A return spring 7 constituted by a coiled spring of a predetermined biasing force is disposed within the receptacle space 4*d* formed in the cylindrical portion 4*c* of the operating shaft 4. The return spring 7 is disposed in such a manner that its upper and lower ends are in elastic contact respectively with the ceiling surface of the receptacle space 4*d* in the cylindrical portion 4*c* and with the upper surface of the boss portion 6*c* of the operating member 6. The return spring 7 is fitted on the shaft portion 4*g* and one end portion thereof located on the knob portion 4*a* side is guided by the inner wall of the cylindrical portion 4*c*, while the opposite end portion thereof is guided by the outer wall of the boss portion 6*b*, to restrict front, rear and right, left motions of the return spring.

Below the operating member 6 is disposed a bottom plate 8 which closes the lower portion of the frame 1. The bottom plate 8 is formed in a generally rectangular external shape using a resin material and it comprises side walls 8*a* formed partially and a flat inner bottom 8*b* formed inside the side walls 8*a*.

The operating member 6 is brought into elastic contact with the inner bottom 8*b* of the bottom plate 8 by virture of the return spring 7. A component mounting portion 8*c* for mounting an electric component such as a push-button switch 9 projects from one side wall 8*a* of the bottom plate 8. On the side walls 8*a* adjacent to the side wall 8*a* with the component mounting portion 8*c* formed thereon there are formed projectingly a plurality of guide portions 8*d* for positioning the lower ends of the side plates 1*c* and 1*d* of the frame 1.

The push-button switch 9 attached to the component mounting portion 8*c* comprises a stem portion 9*a* which can turn an internal circuit (not shown) ON and OFF, a case 9*b* which encloses the internal switch circuit therein in a hermetically sealed state, and a plurality of mounting terminals 9*c* extending downward from side faces of the case 9*b*. The mounting terminals 9*c* of the push-button switch 9 can be temporarily fixed to the component mounting portion 8*c* of the bottom plate 8 by snap-fitting for example.

In assembling the multi-way input device constructed as above, the first interlocking member 2 of an arcuate shape is inserted into the frame 1 from the lower open side of the frame and its component operating portion 2*c* is inserted into a circular hole (not shown) formed in the side wall 1*c*, while its support portion 2*b* is inserted into the circular hole 1*g* formed in the side plate 1*d*. In this way the first interlocking member 2 is mounted in the interior of the frame 1.

Next, the cylindrical portion 4*c* of the operating shaft 4 is inserted into the slot 5*c* of the second interlocking member 5 until the convex pivot shaft portions 4*f* are positioned on the chamfered guide portions 5*e* of side walls 5*b*. In this state, the operating shaft 4 is pushed down in the slot 5*c* with use of a jig (not shown) or the like, whereby the side walls 5*b* are deformed elastically and expanded outwards and hence the convex pivot shaft portions 4*f* are brought into engagement by snap-fitting with the concave engaging portions 5*d* of the side walls 5*b*. In this way the operating shaft 4 is pivotally supported by the second interlocking member 5.

Next, grease is applied into spaces formed by both-side linear portions in the oval shape of each pivot shaft portion 4*f* and the circular engaging portion 5*d* to prevent the occurrence of creak or any other inconvenience between the operating shaft 4 and the second interlocking member 5.

Then, the knob portion 4*a* of the operating shaft 4 thus supported by the second interlocking member 5 is inserted through the slit 2*a* of the first interlocking member 2 and is projected outwards from the operating hole 1*f* of the frame 1, allowing its circular base end portion 4*b* to be positioned in the slit 2*a*.

Further, the support portion 5*h* of the first arm portion 5*f* in the second interlocking member 5 is inserted into the circular hole 1*g* of the side plate 1*a*, allowing the component operating portion 5*j* formed as a tip portion to be projected outwards from the side plate 1*a*, and the support portion 5*k* of the second arm portion 5*g* is positioned in the support portion 1*h* of the side plate 1*b* of the frame 1.

Next, the frame 1 with the first and second interlocking members 2, 5 thus mounted therein is turned upside down, allowing the lower opening to face up. The return spring 7 is then inserted into the receptacle space 4*d* of the cylindrical portion 4*c* of the thus-inverted operating shaft 4.

Then, the axial bore 6*c* of the operating member 6 is fitted on the lower end 4*h* of the operating shaft 4, whereby the boss portion 6*b* of the operating member 6 is fitted movably into the cylindrical portion 4*c* of the operating shaft 4 and the boss portion 6*b* of the operating member 6 comes into elastic contact with the return spring 7.

The bottom plate 8 with the push-button switch 9 secured to the component mounting portion 8*c* temporarily is inverted and attached to the inverted frame 1. At this time, end portions of the side plate 1*c* are guided by the guide portions 9*d* and the frame 1 is thereby positioned on the bottom plate 8. At the same time, the component holding legs 1*j* of the side plate 1*b* are positioned on the upper surface of the case 9*b* of the push-button switch 9 and the push-button switch is fixed to the bottom plate 8.

When the plural tongue pieces 1*m* extending downward from the side plates 1*a* and 1*b* of the frame 1 are caulked, the bottom plate 8 is rendered integral with the frame 1, the operating member 6 comes into elastic contact with the inner bottom 8*b* of the bottom plate 8, and the operating shaft 4 assumes its upright neutral state, as shown in FIG. 8.

Next, the operating portion 3*e* of one variable resistor 3 is brought into engagement with the component operating portion 5*j* of the second interlocking member 5 projecting outwards from the circular hole 1*g* formed in the side plate 1*a* and the variable resistor 3 is engaged by snap-fitting with a plurality of rectangular holes (not shown) formed in the side plate 1*a* and is thereby locked to the side plate 1*a*.

Likewise, the operating portion 3*e* of the other variable resistor 3 is brought into engagement with the component operating portion 2*c* of the first interlocking member 2 projecting outwards from the side plate 1*c* and the variable resistor 3 is secured to the side plate 1*c*. The assembling work for the multi-way input device is now over.

Although in the assembling work described above the electric components, i.e., the variable resistors 3, are secured to the frame 1 after mounting the first and second interlocking members 2, 5 to the frame, the variable resistors 3 may be mounted before mounting the first and second interlocking members 2, 5 to the frame 1.

The operation of the multi-way input device will now be described. First, when any operating force is not applied to the knob portion 4*a* of the operating shaft 4, that is, with no load applied, the operating member 6 is brought into elastic contact with the inner bottom 8*b* of the bottom plate 8 under the biasing force of the return spring 7 and the dish-like bottom of the base portion 6*a* of the operating member 6 assumes a horizontal state, while the operating shaft assumes its upright neutral state.

When the operating shaft 4 in the neutral state is tilted in an arrow B direction in FIG. 8 along the slit 2*a* formed in the first interlocking member 2, the second interlocking member 5 turns with the support portions 5*h* and 5*k* of the first and second arm portions 5*f*, 5*g* respectively as fulcrums. Further, as shown in FIG. 9, the bottom of the base portion 6*a* of the operating member 6 moves in sliding contact with the upper surface of the inner bottom 8*b* of the bottom plate 8 and the operating member 6 tilts while part of the outer periphery of the bottom of the base portion 6*a* is positioned on the inner bottom 8*b* of the bottom plate.

The boss portion 6*b* of the operating member 6 is pushed into the receptacle portion 4*d* of the cylindrical portion 4*c* of the operating shaft 4 against the biasing force of the return spring 7.

When the second interlocking member 5 is rotated, the slider receptacle portion 3*d* of the variable resistor 3 with which the component operating portion 5*j* of the first arm portion 5*f* is engaged, rotates and the resistance value of the variable resistor 3 changes.

When the operation of the variable resistor 3 attached to the side plate 1*a* is over and the operating force which has been exerted on the operating shaft 4 is relieved, the operating member 6 reverts to its horizontal state automatically with the biasing force of the return spring 7 and the operating shaft 4 reverts to its upright neutral state automatically.

When the operating shaft 4 is tilted in an arrow A—A direction in FIG. 10 along the slot 5*c* of the second interlocking member 5, the first interlocking member 2 rotates with both support portion 2*b* and component operating portion 2*c* as fulcrums.

Upon rotation of the first interlocking member 2, the slider receptacle portion 3*d* of the variable resistor 3, which is attached to the side plate 1*c* and with which the component operating portion 2*c* is engaged, rotates and the resistance value of the variable resistor 3 changes. At this time the operating member 6 operates in the same manner as in the case where the operating shaft 4 is tilted in an arrow B—B direction, so an explanation thereof will be omitted.

For operating the push-button switch 9, which is an electric component other than the variable resistors 3, the operating shaft 4 is pushed downward in an arrow C direction. As a result, the pushing force is imposed on the engaging portions 5*d* of the second interlocking member 5 and the second arm portion 5*g* moves downward with the support portion 5*h* of the first arm portion 5*f* as a fulcrum.

With this movement of the second arm portion 5*g*, the component operating portion 5*m* of the second arm portion 5*g* projecting outward from the support portion 1*h* of the frame side plate 1*b* moves vertically and pushes the stem portion 9*a* of the push-button switch 9. In this way the push-button switch 9 can be turned ON and OFF.

The operating shaft 4 can be pushed in an arrow C direction not only when the operating shaft is in its neutral state but also when it is tilted to change the resistance value of the variable resistor 3.

Figure 14A:
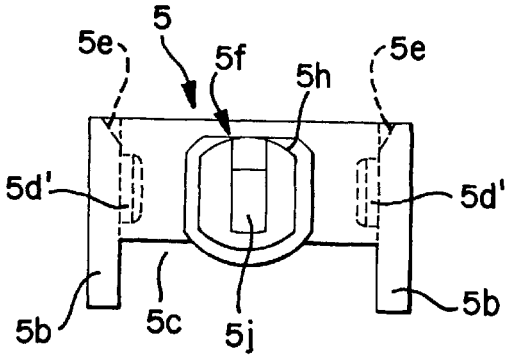
FIG. 14 is a side view of the second interlocking member in a second embodiment.
Figure 14B:
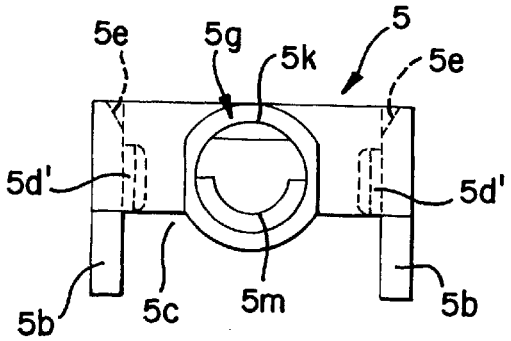
Figure 15:
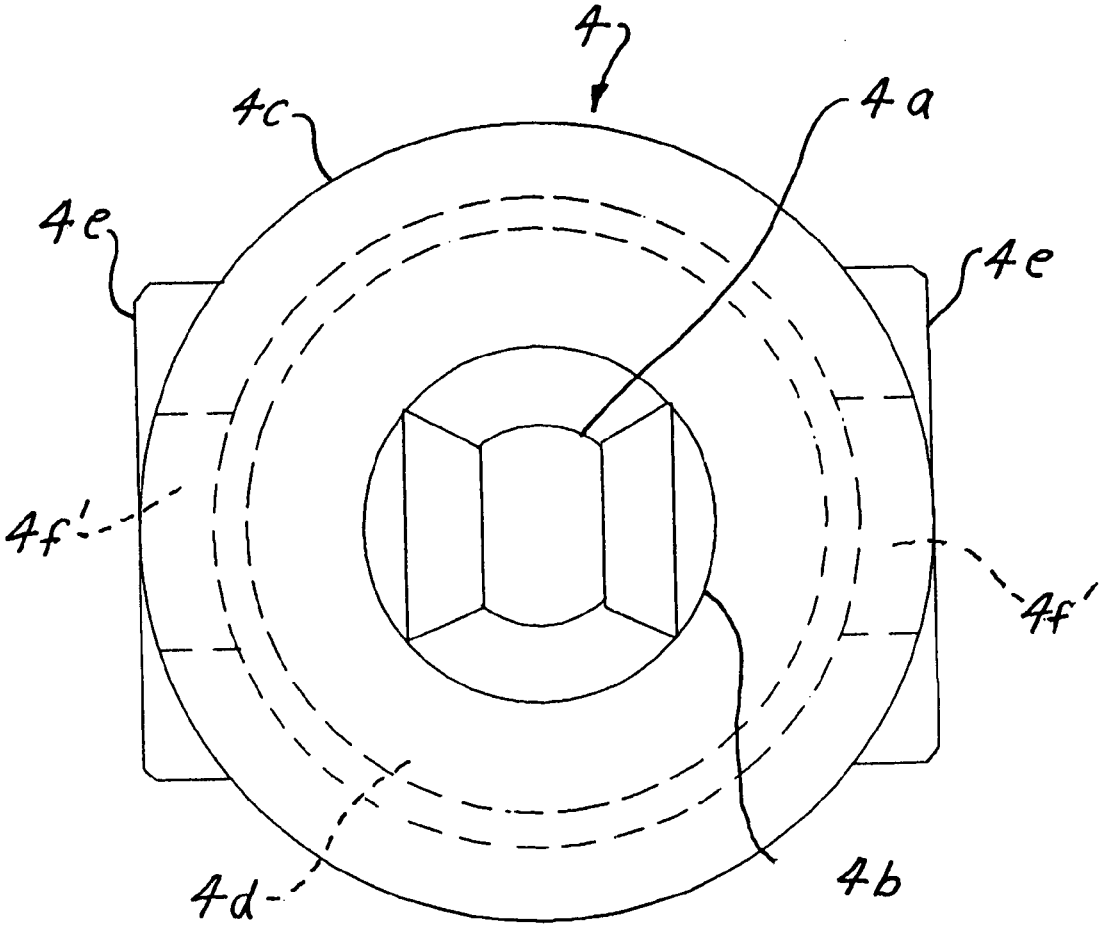
FIG. 15 is a top view of the interlocking shaft in a second embodiment.

Although in the above embodiment the pivot shaft portions 4 on the operating shaft 4 side are formed in a convex shape and the engaging portions 5*d* of the second interlocking member 5 are formed in a concave shape, as shown in FIG. 14 and FIG. 15 the former may be formed concavely into pivot shaft portions 4*f* and the latter convexly into engaging portions 5*d*.

Although in the above embodiment both the operating shaft 4 and the second interlocking member 5 are formed using an elastically deformable resin material, either one may be formed using such an elastically deformable resin material and the other formed using a metallic material such as a die casting alloy.

Although in the above embodiment the guide portions 5*e* for guiding the pivot shaft portions 4*f* of the operating shaft 4 to the engaging portions 5*d* of the second interlocking member 5 are formed by chamfering, the guide portions 5*e* may be, for example, grooves (not shown) formed in the inner surfaces of side walls which define the slot 5*c* of the second interlocking member, the grooves extending up to near the engaging portions 5*d*.

Although in the above embodiment the variable resistors 3 and the push-button switch 9 were used as plural electric components, any other electric components may be used if only they can be rotated or pushed.

Although in the above embodiment the cylindrical portion 4*c* of the operating shaft 4 has a peripheral wall as an enclosure and its lower side is open, the other portion than the portions where the pivot shaft portions 4*f* are formed may be open. In this case, the pivot shaft portions 4*f* become easier to undergo an elastic deformation and therefore the snap-fitting can be done more smoothly.

In the multi-way input device of the present invention, the operating shaft has pivot shaft portions of a convex or concave shape and the second interlocking member has engaging portions of a concave or convex shape for engagement with the pivot shaft portions of the operating shaft, the engaging portions being formed in side walls of the second interlocking member which define a slot, the engaging portions of the second interlocking member and the pivot shaft portions of the operating shaft being engaged with each other by snap-fitting, thereby allowing the operating shaft to be pivotably supported by the second interlocking member. According to this construction, the operating shaft can be supported by the second interlocking member easily by manual operation without the need of any special means such as a jig.

Moreover, since the operating shaft has a cylindrical portion and the pivot shaft portions of the operating shaft are formed on part of an outer wall of the cylindrical portion, the hollow space in the interior of the cylindrical portion permits the cylindrical portion to undergo an elastic deformation when the pivot shaft portions of the operating shaft are engaged by snap-fitting with the second interlocking member. Consequently, the operation for engaging the operating shaft with the second interlocking member by snap-fitting becomes easier and thus the multi-way input device is superior in its assembling work efficiency.

Further, since the operating shaft and/or the second interlocking member are (is) formed using an elastically deformable material, the snap-fitting operation for the operating shaft with respect to the second interlocking member can be done more easily.

Further, since guide portions for guiding the pivot shaft portions to the engaging portions are formed in part of side walls of the second interlocking member which define the foregoing slot, the pivot shaft portions of the operating shaft can surely be guided to the engaging portions of the second interlocking member and the multi-way input device is superior in its assembling work efficiency.

What is claimed is:

1. A multi-way input device comprising:

a first interlocking member which has a longitudinal slit and which is rotatable;

a second interlocking member disposed in a direction orthogonal to the longitudinal direction of said first interlocking member; said second interlocking member having a slot and being rotatable;

a frame within which said first and second interlocking member are mounted;

an operating shaft inserted through both said slit of the first interlocking member and said slot of the second interlocking member and supported tiltably by the second interlocking member; and a plurality of electric components attached to said frame and capable of being operated through said first and second interlocking members by operation of said operating shaft, said operating shaft having pivot shaft portions of a convex or concave shape formed thereon, and said second interlocking member having engaging portions of a concave or convex shape for engagement with said pivot shaft portions, said engaging portions being formed on walls defining the slot of the second interlocking member, said engaging portions of the second interlocking member and said pivot shaft portions of the operating shaft being engaged with each other by snap-fitting, thereby allowing the operating shaft to be pivotably supported by the second interlocking member.

2. A multi-way input device according to claim 1, wherein said operating shaft has a cylindrical portion, and said pivot shaft portions of said operating shaft are formed on part of an outer wall of said cylindrical portion.

3. A multi-way input device according to claim 1, wherein at least one of said operating shaft and said second interlocking member is formed of an elastically deformable material.

4. A multi-way input device according to claim 1, wherein guide portions for guiding said pivot shaft portions of the operating shaft to said engaging portions of the second interlocking member are formed in part of side walls of the second interlocking member which define said slot.

* * * * *

UNITED STATES PATENT AND TRADEMARK OFFICE

CERTIFICATE OF CORRECTION

PATENT NO. : 6,150,919
DATED : November 21, 2000
INVENTOR(S) : Hisato Shimomura

It is certified that error appears in the above-identified patent and that said Letters Patent is hereby corrected as shown below:

Claim 1,
Line 9, change "member" to -- members --.

Signed and Sealed this

Eighteenth Day of December, 2001

*Attest:*

*Attesting Officer*

JAMES E. ROGAN
*Director of the United States Patent and Trademark Office*